United States Patent [19]

Van Dam, Jr.

[11] 4,368,569

[45] Jan. 18, 1983

[54] HOSE CLAMP TOOL

[76] Inventor: John Van Dam, Jr., 2060 Swensburg Ave., NE., Grand Rapids, Mich. 49505

[21] Appl. No.: 236,703

[22] Filed: Feb. 23, 1981

[51] Int. Cl.[3] ..... B25B 27/00

[52] U.S. Cl. ..... 29/229; 29/270

[58] Field of Search ..... 29/229, 225, 270; 140/106, 117, 118, 123; 81/3 R; 254/25

[56] References Cited

U.S. PATENT DOCUMENTS

| | | | |
|---|---|---|---|
| 409,434 | 8/1889 | Taylor et al. | 140/118 |
| 588,438 | 8/1897 | Johnson et al. . | |
| 868,952 | 10/1907 | White | 81/3 R |
| 898,568 | 9/1908 | Emmerson | 254/25 |
| 2,910,899 | 11/1959 | Pasqualone et al. | 81/913 |
| 3,087,751 | 4/1963 | Nisenbaum et al. | 292/264 |
| 3,800,634 | 4/1974 | Clayton | 29/229 |

FOREIGN PATENT DOCUMENTS

| | | | |
|---|---|---|---|
| 106083 | 12/1938 | Australia | 140/123 |
| 463802 | of 1914 | France . | |
| 207198 | 10/1978 | German Democratic Rep. | 29/270 |

*Primary Examiner*—James L. Jones, Jr.
*Attorney, Agent, or Firm*—Glenn B. Morse

[57] ABSTRACT

A tool for manipulating standard resilient hose clamps is in the form of a flat plate with a keyhole-shaped opening adapted to receive the radial ends of the clamp.

1 Claim, 4 Drawing Figures

HOSE CLAMP TOOL

BACKGROUND OF THE INVENTION

Hoses are common components of many forms of machinery, notably the automobile. Typically, they will form a conduit for liquid extending between sections of the machine that may be expected to have some small degree of relative motion with respect to each other. The ends of the hose are usually secured to tubular extensions by constricting clamps in which the constricting action is generated by either a mechanical arrangement, or by the resilience of the material of the clamp. This latter form of clamp has been developed to a point of admirable simplicity, and commonly consists of nothing more than a spiral turn of a rather heavy steel wire, the ends of which slightly overlap to produce the spiral rather than a purely circular configuration. The extreme ends of this piece of wire are bent into substantially radial extensions, which can be gripped by a pair of pliers and brought together to increase the diameter enclosed by the device. In this position, it may be slipped on or off the end of the tubing. On release of the radial ends, the resilience of the device constricts it about the hose, and holds it securely in position on the tubular extension with which it is associated.

Holding and manipulating these clamps with a pair of pliers requires a considerable skill, and it is obvious that the release of manual force from the pliers will produce a corresponding release of the clamp, unless the pliers are of the special form capable of maintaining its grip. Such pliers have a limit to the clamping travel of the jaws, which might not be adequate to loosen the hose clamp enough for an easy installation or removal.

Special tools have been devised that are capable of engaging the radial ends of this form of hose clamp, and bring them together to increase the effective diameter of the clamp through rotating the tool about an axis generally parallel to the radial end portions of the clamp. The rotation has the effect of applying a cam surface to at least one of the ends, and thus inducing the force necessary to overcome the spring resilience of the hardened steel wire. The tool configurations that have been developed to provide these cam surfaces have tended to be somewhat more complicated than now appears to be necessary. The present invention provides a low-cost simplification of this general type of tool.

SUMMARY OF THE INVENTION

This hose clamp tool is formed by a flat plate having a keyhole-shaped opening adjacent one end. The narrow portion of the keyhole opening is of sufficient length to receive the normal spacing of the radial ends of the clamp in their relaxed condition (which represents the maximum spacing). Rotation of the tool about an axis generally parallel to the radial ends causes the side walls of the narrow portion of the keyhole opening to function as a cam, and bring the radial clamp ends closer together. The enlarged portion of the keyhole opening is preferably arcuate, and of a sufficient diameter to accept both of the ends of the clamp.

DESCRIPTION OF THE PREFERRED EMBODIMENT

Figure 1:
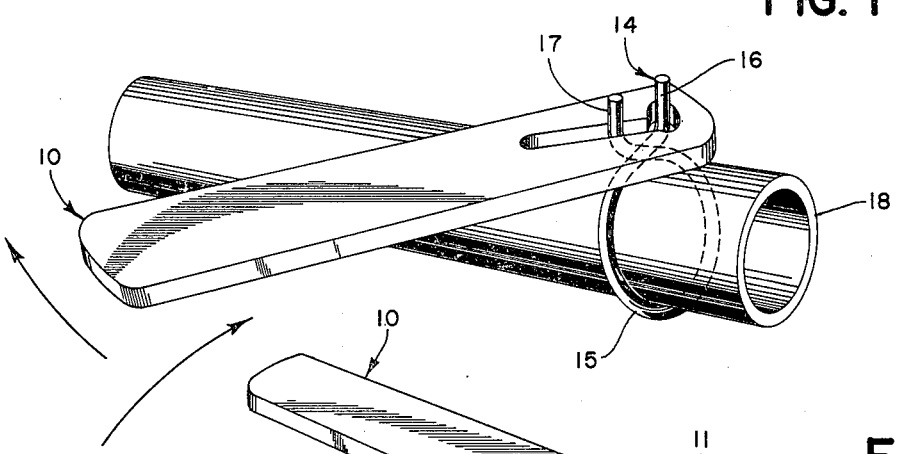
FIG. 1 is a perspective view showing the tool in engagement with clamp that has been slipped over the end of a hose.
Figure 2:
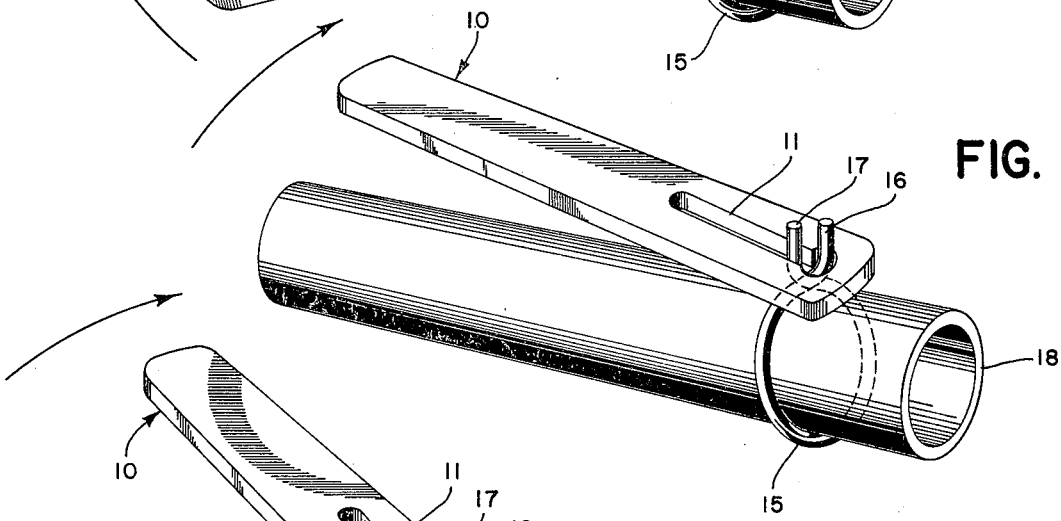
FIG. 2 illustrates an intermediate position in the manipulation of the tool to increase the diameter of the clamp by bringing the overlapped ends together.
Figure 3:
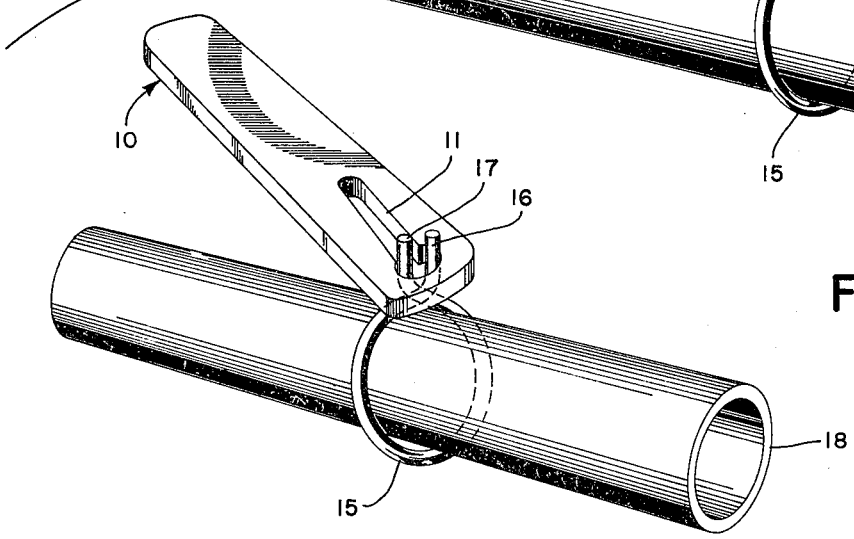
FIG. 3 shows the final position in which both of the ends of the clamp are trapped in the wider portion of the keyhole opening.
Figure 4:
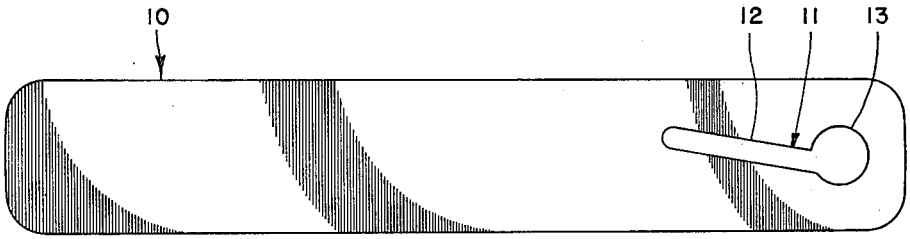
FIG. 4 is a plan view of the tool itself.

The tool generally indicated at 10 in the drawings is preferably in the form of a flat plate on the order of an eighth of an inch in thickness, and of a size to be gripped conveniently by the hand. Most of the length of this plate functions as a handle, and one end is provided with a keyhole-shaped opening indicated at 11, and having a relatively narrow portion 12 and a relatively wider portion 13. The width of the narrow portion is preferably slightly greater than the diameter of the wire forming the standard resilient hose clamp indicated at 14. This device is essentially slightly more than a single turn of hardened steel wire formed so that the ends overlap slightly to produce a spiral configuration. The constricting portion 15 terminates in the substantially radial end portions 16 and 17, which are received within the keyhole opening 11 of the tool. The diameter of the enlarged arcuate portion 13 of the keyhole opening is slightly greater than twice the diameter of the wire forming the clamp, so that the clamp can be received in the opening as shown in FIG. 3. In the FIG. 3 position, the grip on the hose 18 is completely released, and the natural resilience of the clamp causes it to constrict about the hose as shown in FIG. 1 as soon as the forces of the tool are removed by placing it in the FIG. 1 position. Experiments with various configurations of the tool have established that it is preferable for the arcuate end portion 13 to be slightly eccentric to the axis of the narrow portion 12, as shown in FIG. 4, for the most effective retention of the clamp in the tool in the FIG. 3 position. In this position, the tool may be left in engagement with the clamp when the clamp is removed, and the tool and clamp handled as a unit during both removal and installation.

As can be seen from FIG. 4, the center of the arcuate portion 13 is, preferrably, offset from the axis of the narrow or slot portion 12 and the imaginary lines of extension of the sides of the slot portion both intersect the arcuate portion at two points, being secants thereof. The slot portion extends from the arcuate portion at an acute angle relative to the longitudinal axis of the plate.

I claim:

1. A tool for manipulating a resilient wire hose clamp of the type having an arcuate portion and ends terminating in substantially radially outwardly extending projections overlapping in the relaxed condition of said clamp, said tool comprising:

a substantially flat, rectangular plate having, adjacent one end thereof, a generally keyhole-shaped opening formed of a first, arcuate portion adjacent said one end of said plate and a second, parallel sided slot portion extending from the first portion at an acute angle to the longitudinal axis of said plate and away from the said one end thereof, the diameter of said arcuate portion being slightly greater than twice the diameter of the wire forming said hose clamp, the length of said slot portion being of sufficient length to receive both said projections in the relaxed condition of said clamp, the width of said slot portion being slightly greater than the diameter of said wire, the center of said arcuate portion being offset from the axis of said slot portion, and the lines of extension of said parallel sides across said arcuate portion being secants thereof, the remainder of said plate beyond said slot portion being adapted as a handle.

* * * * *